US008373623B2

(12) United States Patent
Lee

(10) Patent No.: US 8,373,623 B2
(45) Date of Patent: Feb. 12, 2013

(54) AUTOMATIC HIGH VOLTAGE GATE DRIVER IC (HVIC) FOR PDP

(75) Inventor: Dong Young Lee, Torrance, CA (US)

(73) Assignee: International Rectifier Corporation, El Segundo, CA (US)

( * ) Notice: Subject to any disclaimer, the term of this patent is extended or adjusted under 35 U.S.C. 154(b) by 684 days.

(21) Appl. No.: 11/668,276

(22) Filed: Jan. 29, 2007

(65) Prior Publication Data

US 2007/0176856 A1 Aug. 2, 2007

Related U.S. Application Data

(60) Provisional application No. 60/763,546, filed on Jan. 31, 2006.

(51) Int. Cl.
*G09G 3/28* (2006.01)

(52) U.S. Cl. ..... 345/68; 345/60

(58) Field of Classification Search ..... 345/68, 345/60

See application file for complete search history.

(56) References Cited

U.S. PATENT DOCUMENTS

| | | | | |
|---|---|---|---|---|
| 4,677,317 | A * | 6/1987 | Sakuma | 326/81 |
| 5,502,632 | A | 3/1996 | Warmerdam et al. | |
| 6,529,061 | B1 * | 3/2003 | Orita | 327/381 |
| 2004/0212021 | A1 * | 10/2004 | Shimizu | 257/375 |

* cited by examiner

*Primary Examiner* — Kevin M Nguyen
*Assistant Examiner* — Kenneth B Lee, Jr.
(74) *Attorney, Agent, or Firm* — Farjami & Farjami LLP

(57) ABSTRACT

A PDP sustain driver circuit including at least one high voltage gate driver IC (HVIC) having a logic functional block. The PDP sustain driver circuit includes a signal buffer for receiving two input signals and providing the two signals to the logic functional block; and at least four switches including a charging switch, a discharging switch, a sustain switch and a grounding recovery switch, the HVIC providing a unique control signal from the logic functional block to the four switches to control said four switches.

20 Claims, 10 Drawing Sheets

AUTOMATIC HIGH VOLTAGE GATE DRIVER IC (HVIC) FOR PDP

CROSS-REFERENCE TO RELATED APPLICATION

This application is based on and claims priority to U.S. Provisional Patent Application Ser. No. 60/763,546, filed on Jan. 31, 2006 and entitled AUTOMATIC HIGH VOLTAGE GATE DRIVER IC (HVIC) FOR PDP, the entire contents of which are hereby incorporated by reference herein.

BACKGROUND OF THE INVENTION

The present invention relates to Plasma Display Panel (PDP) gate drivers, and more particularly to an automatic high voltage gate driver IC (HVIC) for PDP.

PDP HVICs include an internal logic functional block for a PDP sustain driver. FIG. 1 shows a conventional PDP sustain driver 10, which is a half-bridge driver with soft switching for a capacitive load. The PDP sustain driver 10 consists of four switches, including a rising switch 12, a falling switch 14, a sustain switch 16, and a ground switch 18. These switches may be n-channel type field effect transistors. The PDP sustain driver 10 further includes a capacitor 20, diodes 24 and 26, and an inductor 28. Capacitor 22 represents the Plasma Display Panel capacitance $C_P$.

A conventional sustain driver 10 requires four input signals, the four input signals being connected to gates of each of the switches 12, 14, 16, and 18, each signal driving a unique switch. FIG. 2 shows a conventional sustain driver 30 that uses four input signals. It includes four switches 12, 14, 16, and 18; capacitor 20; diodes 24 and 26 and an inductor 28. Capacitor 22 ($C_P$) is the panel capacitance. The driver 30 further includes a signal buffer 36 and two HVICs 32 and 34. The signal buffer 36 receives four signals, a signal ERR for the rising switch 12, a signal SUS for the sustain switch 16, a signal ERF for the falling switch 14, and the signal GRND for a ground switch 12. The HVIC 32 is connected to and controls the rising switch 12 and the sustain switch 16. The HVIC 34 is connected to and controls the falling switch 14 and the ground switch 18. Accordingly, each switch 12, 14, 16, and 18 is independently controlled. This, however, commands high cost and space for a four input signal printed circuit board (PCB) pattern, as well as multiple cables from a timing controller and the signal buffer 36.

The switch 16 has one end connected to a power supply terminal ($V_{BUS}$). The switch 18 has one end connected to the ground terminal; the other ends of the switches 16 and 18 are interconnected at a node A. The node A is connected to a plurality of sustain electrodes represented in FIG. 1 as a panel capacitance $C_P$ 22 corresponding to the total capacitance between the plurality of sustain electrodes and the ground terminal.

The switch 12 and the diode 24 are series connected between the node B and the recovering capacitor $C_r$ 20 that is also connected to the ground terminal. The diode 26 and switch 14 are similarly connected in series between the node B and the recovering capacitor $C_r$ 20.

When the control signal to the switch 18 attains a low level, the switch 18 turns off, while when the control signal to the switch 12 attains a high level, the switch 12 turns on. At the time, the control signal to the switch 16 is at a low level, and the switch 16 is in an off state, while the control signal to the switch 14 is at a low level, and the switch 14 is in an off state. Therefore, the recovering capacitor $C_r$ 20 is connected to the recovering coil 28 through the switch 12 and the diode 24, and LC resonance by the recovering coil 24 and the panel capacitance $C_P$ 22 causes the voltage at the node A to gradually rise. At the time, charges from the recovering capacitor $C_r$ 20 are discharged to the panel capacitance $C_P$ 22 through the switch 12, the diode 24 and the recovering coil 28. The sustain switch 16 turns on after switch 12 to sustain the charge on the panel $C_P$. Later, ERF switch 14 turns on to discharge the panel into $C_r$ and GND switch 18 turns on even later to maintain the discharge. Then the cycle repeats to keep the current alternately flowing into the panel $C_P$.

SUMMARY OF THE INVENTION

It would be useful and beneficial to reduce the number of system input signals of the internal logic functional block, e.g., by half. Such reduction would facilitate savings in cost, circuit components, and space including PCB pattern, cabling and in the logic signal buffer.

Thus, it is an object of the present invention to provide a PDP sustain driver that reduces input signals and makes system design easy and cost-effective.

The present invention comprises a PDP sustain driver circuit including at least one high voltage gate driver IC (HVIC) having a logic functional block. The PDP sustain driver circuit includes a signal buffer for receiving two input signals and providing the two signals to the logic functional block; and at least four switches including a charging switch, a discharging switch, a sustain switch and a grounding recovery switch, the HVIC providing a unique control signal from the logic functional block to the four switches to control said four switches.

The HVIC of the invention senses voltage on at least one of the sustain and grounding recovery switches and a sensed result is provided to the logic functional block as a delay setting of the at least one of the sustain and grounding switches.

Other features and advantages of the present invention will become apparent from the following description of the invention that refers to the accompanying drawings.

DETAILED DESCRIPTION OF EMBODIMENTS OF THE INVENTION

Figure 1:
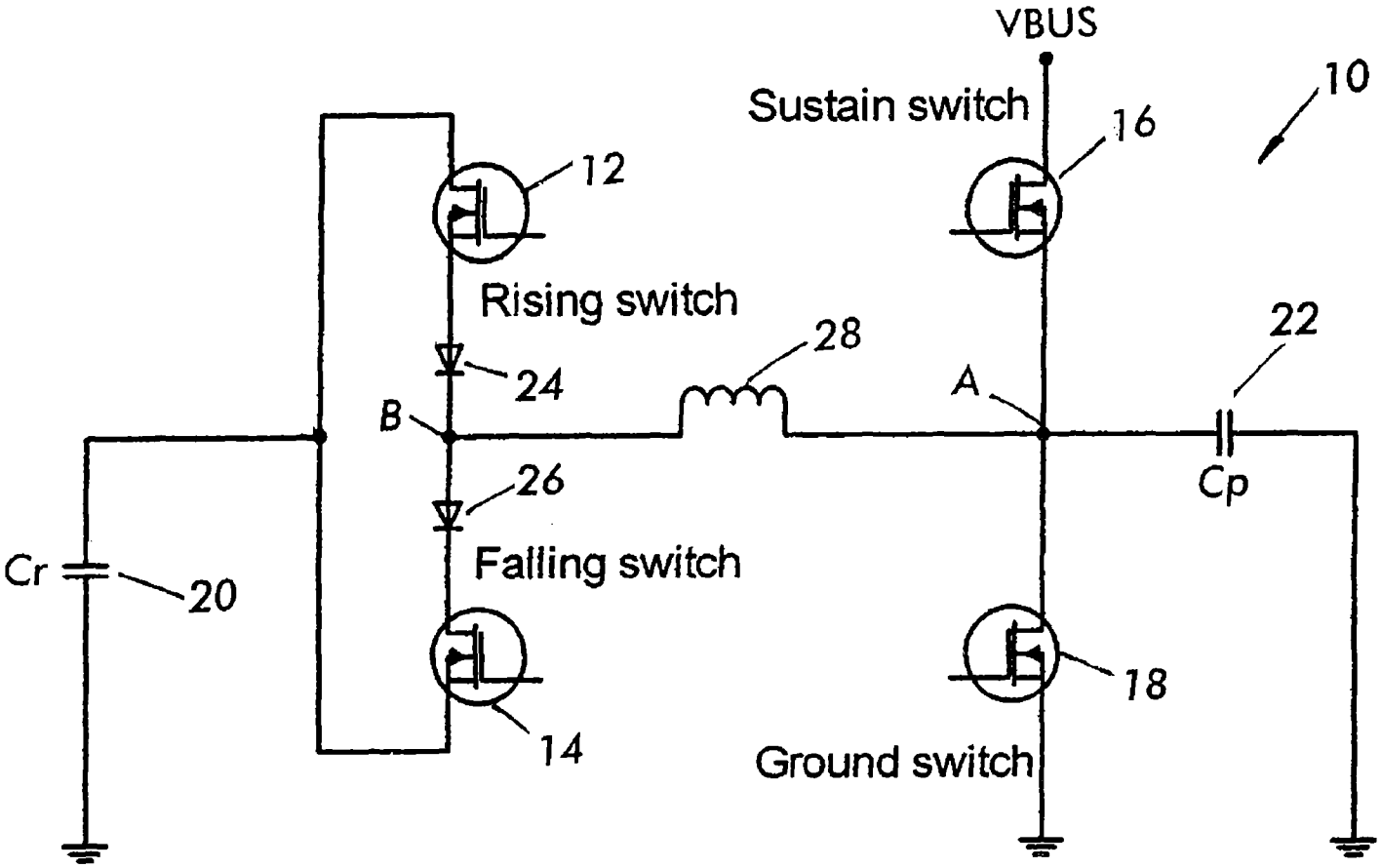
FIG. 1 PRIOR ART
FIG. 1 is a schematic diagram of a conventional PDP sustain driver
Figure 2:
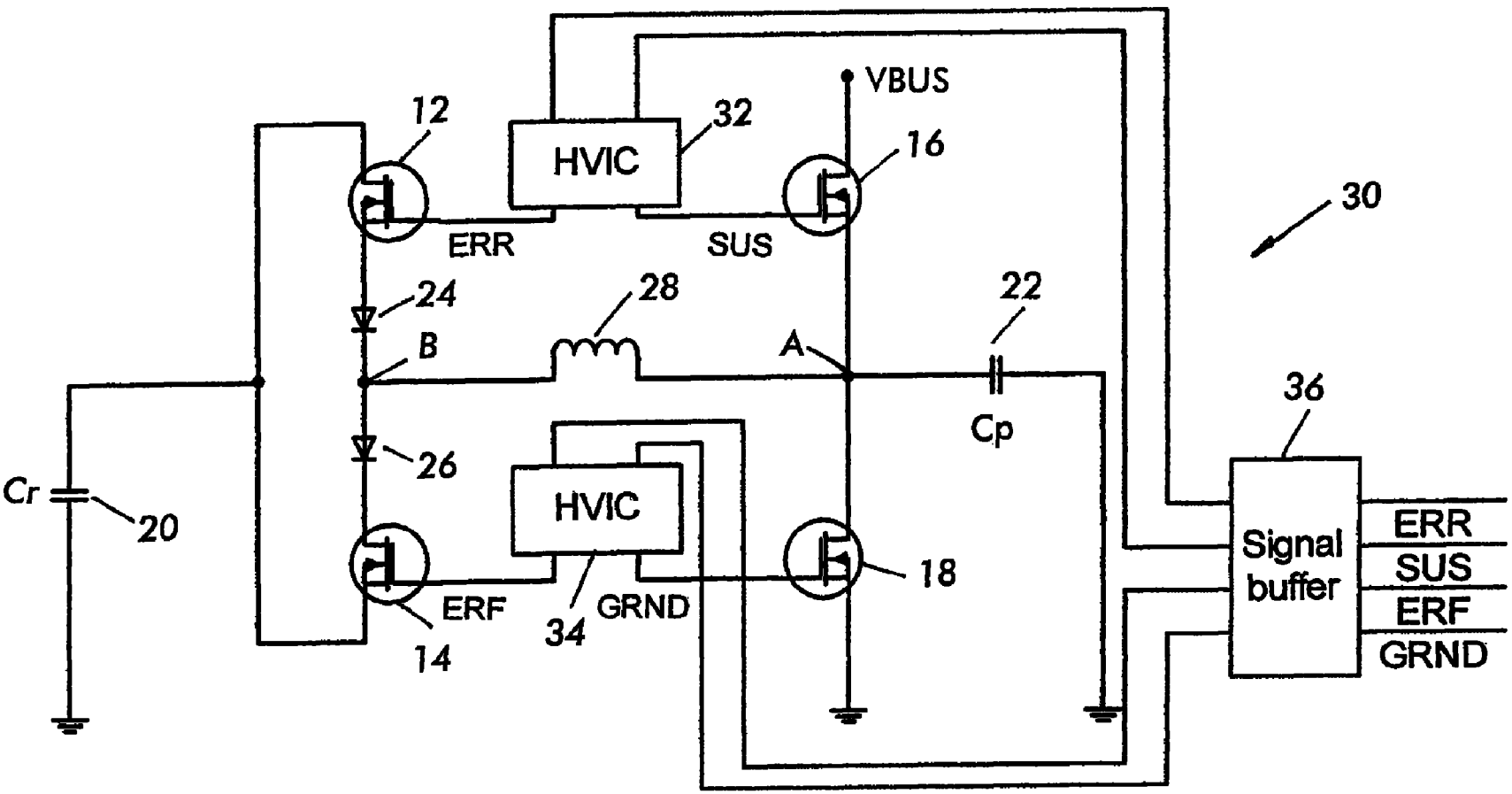
FIG. 2 PRIOR ART
FIG. 2 is a schematic diagram of the conventional PDP sustain driver of FIG. 1 having four inputs connected to switch gates.
Figure 3A:
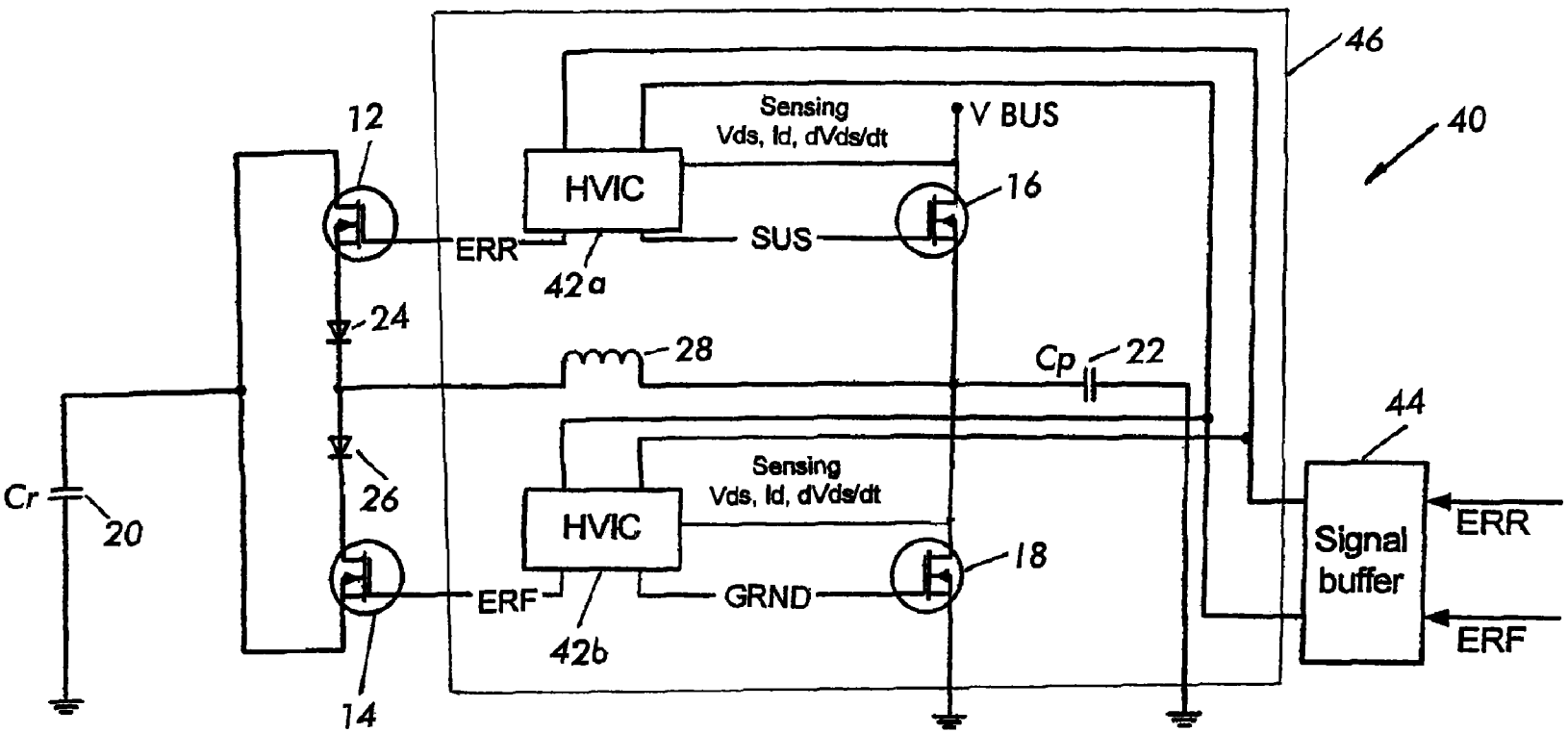
FIG. 3*a* is a schematic diagram of a PDP sustain driver that uses an HVIC having internal logic functions and system information and that only requires two input signals.

FIG. 3*a* shows a sustain driver 40 of the present invention. The sustain driver 40 requires only two input signals and information from the system. The PDP sustain driver 40 includes four switches 12, 14, 16, and 18; capacitor 20 and the PDP capacitance 22; diodes 24 and 26 and an inductor 28. The driver 40 is illustrated to include a signal buffer 44 that receives the ERR and ERF signals. Also, the driver 40 includes two HVICs 42*a* and 42*b* respectively connected to gates of the switches 12/16 and 14/18. The two HVICs share the two input signals by operating in the opposite direction, as will be explained below. For example, the HVIC 42*a* receives the two input signals and the HVICs 42*b* receives the same two input signals reversed.

Figure 3B:
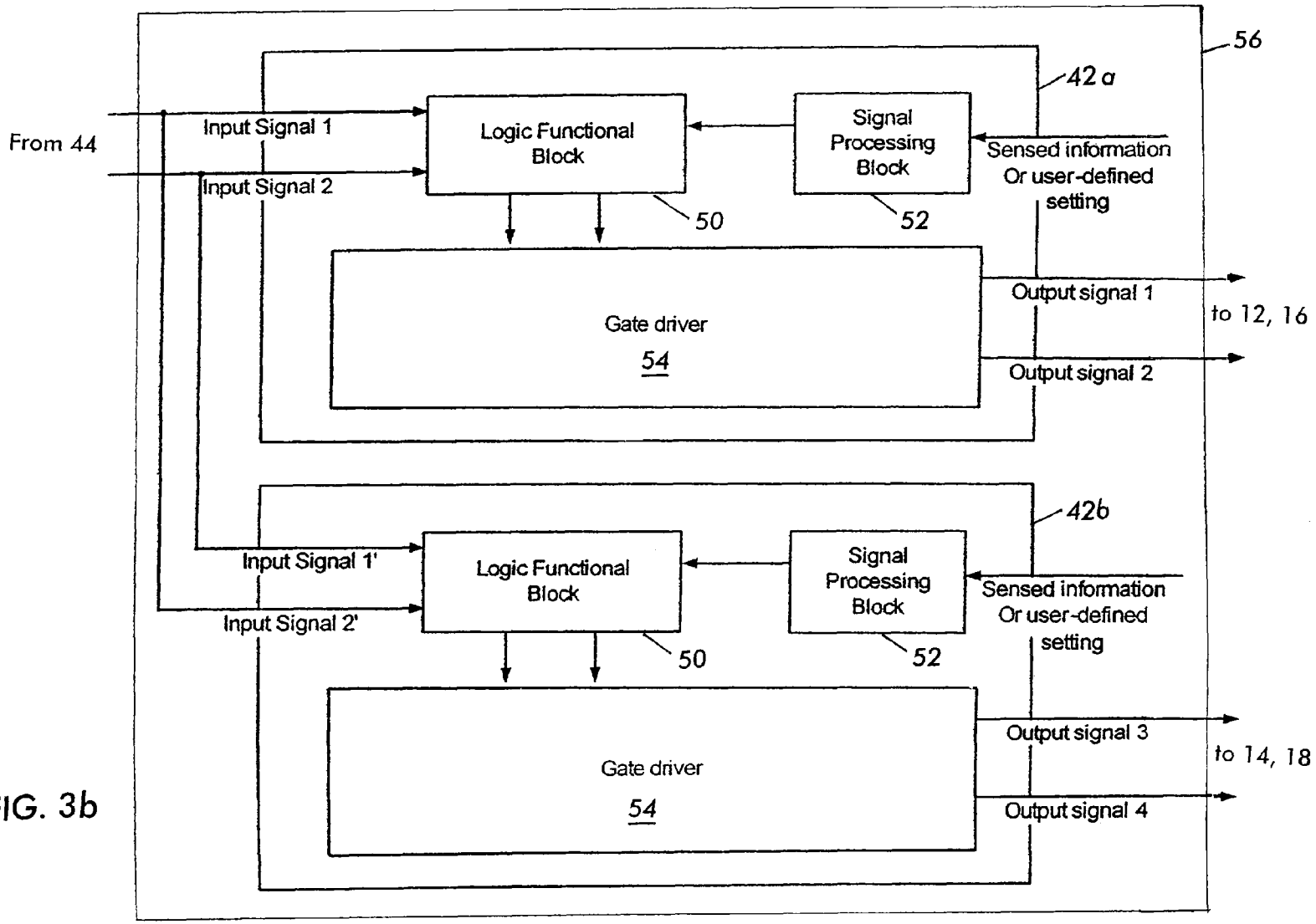
FIG. 3*b* is a block diagram of the HVIC used in the PDP sustain driver of FIG. 3*a;*

As shown in FIG. 3*b*, each HVIC 42 of the present invention receives sensed or user defined information from the switch to which it is connected, or user defined setting information in a signal-processing block 52. This enables the circuit to operate on the two inputs. HVIC 42 further receives the two input signals supplied by the signal buffer 44. The received input signals and data from the signal-processing block 52 are processed in an internal logic functional block 50. The secured information can include switch current, voltage, current slope, voltage slope, temperature of switch, ambient temperature, or other system information.

The logic functional block 50 determines SUS/GRND output gating to achieve optimized gating of the sustain circuit. The logic functional block 50 determines ERR/ERF output gating from the ERR/ERF input signal and provides outputs to drive a gate driver 54. The gate driver 54 then issues two output signals for controlling the switches 12, 16 or 14, 18 (FIG. 3*a*).

As shown in FIG. 3*b*, the two HVICs 42*a* and 42*b* may be consolidated as part of the same circuit 56 and share the input signals. Moreover, as shown in FIG. 3*a* the two HVICs 42*a* and 42*b* may be consolidated in a circuit 46 with other circuit components, for example, the switches 12, 14, 16, 18, and the diodes 24, 26.

Figure 4:
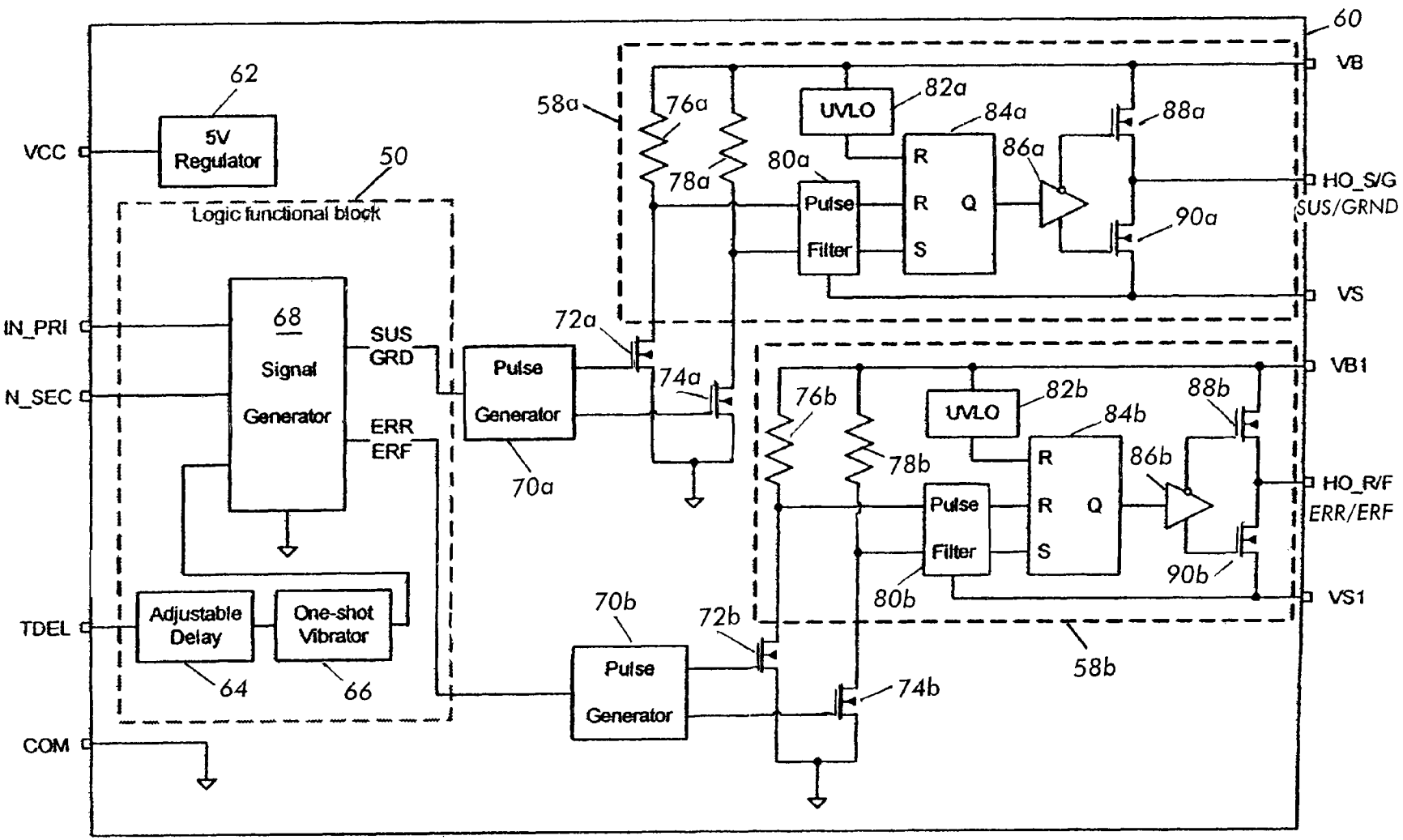
FIG. 4 is a circuit diagram of an exemplary embodiment of the HVIC of the present invention.

FIG. 4 shows an exemplary integrated circuit (IC) 60 utilizing the present invention with delay time setting and operating modes. The IC 60 has terminals for a common COM and a power source VCC connected to a regulator block 62. The IC 60 further includes a logic functional block 50 that accepts primary and secondary inputs $IN_PR_1$ and IN_SEC and a time delay signal TDEL. As discussed above, the logic functional block uses the ERR/ERF primary input signal IN_PRI to determine ERR/ERF output gating. The secondary input signal IN_SEC is used to determine operating modes by sequence combinations. This allows for design freedom for circuit designers.

The time delay signal TDEL is processed by an adjustable delay block 64 and the one-shot vibrator block 66 whose output is provided along with the primary and secondary inputs $IN_PR_1$ and IN_SEC to a signal generator block 68. The signal generator block 68 outputs SUS/GRD and EFF/ERF to two pulse generators 70*a* and 70*b* respectively.

The pulse generator 70 output is coupled to the respective gate driver 54 where each comprises a driver 58*a* and a second driver 58*b*. Each pulse generator 70 output is coupled to gates of switches 72 and 74. Each of the switches 72 and 74 is coupled between the ground and a pulse filter block 80. Resistors 76 and 78 are series coupled to the switches 72 and 74 respectively. The pulse filter block 80 additionally receives a voltage sense VS or VS1 and provides set and reset signals to a flip-flop block 84. An additional reset signal is provided to the flip-flop block 84 by a UVLO block 82 that determines under voltage from floating high side voltage supply VB or VB1. The flip-flop block 84 provides a signal to a driver 86, which controls gates in a complementary manner of switches 88 and 90 series connected at a node that generates a signal HO_S/G (SUS/GRND) for a block 58*a* and a signal HO_R/F (ERR/ERF) for a block 58*b*.

Figure 5:
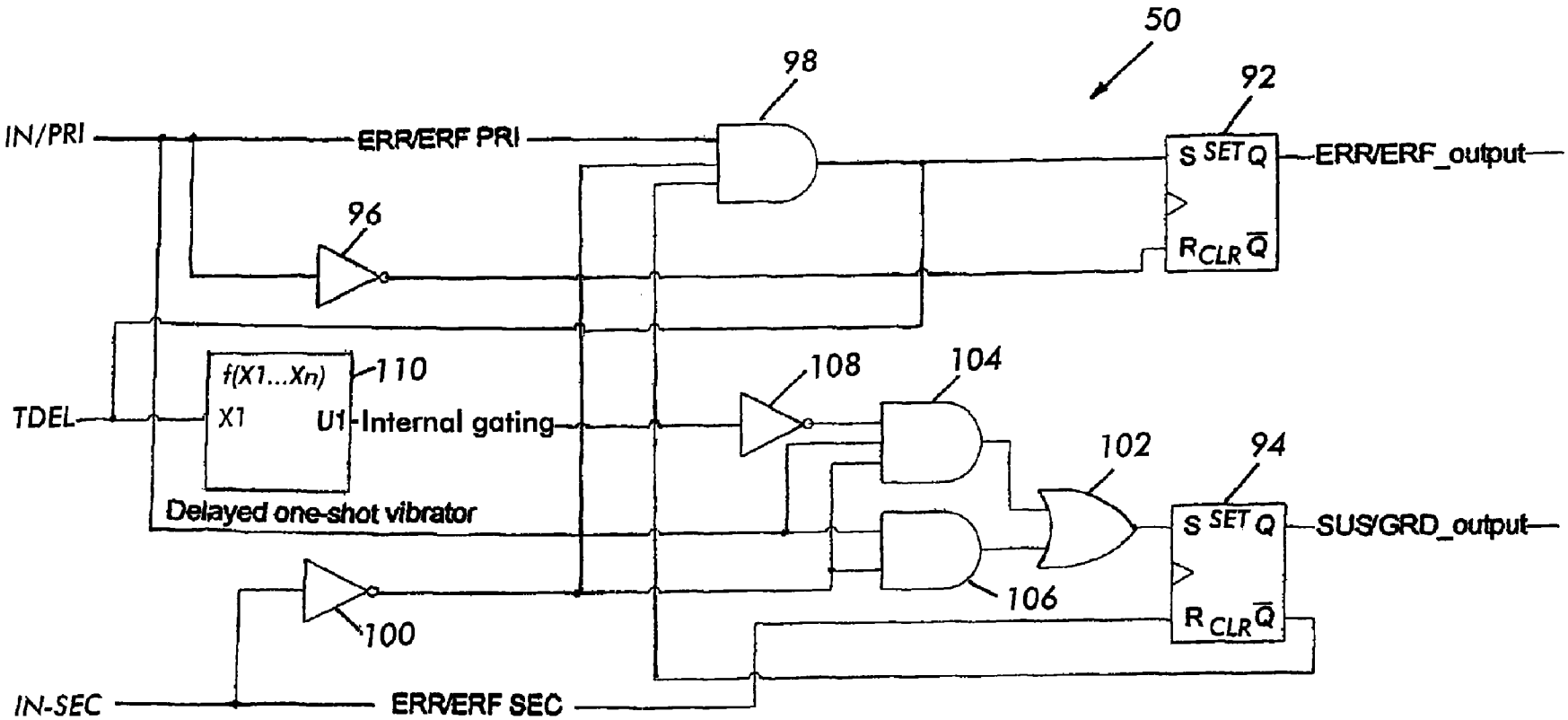
FIG. 5 is a circuit diagram of the logic functional block of FIG. 3*b*.

FIG. 5 shows a diagram of the logic functional block 50 (FIGS. 3*b* and 4) using external time delay setting that produces a logic truth table illustrated in Table 1, below. As shown in FIGS. 3*a* and 4, primary and secondary inputs of ERR and ERF signals are provided to circuit 50. After processing, the circuit 50 provides ERR/ERF and SUS/GRND output from flip-flops 92 and 94 respectively.

The flip-flop 92 receives its reset signal from an inverter 96, which inverts the ERR/ERF primary input signal. A set signal for flip-flop 92 is received from an AND circuit 98, which ANDS the ERR/ERF primary input signal, an inverse of the ERR/ERF secondary input signal from an inverter 100, and an inverse output from the flip-flop 94.

The flip-flop 94 receives its reset signal from the ERR/ERF secondary input signal. A set signal for flip-flop 94 is received from an OR circuit 102, which operates on signals received from AND circuits 104 and 106. The AND circuit 106 operates on the ERR/ERF primary input signal and the inverse of the ERR/ERF secondary input signal from the inverter 100. The AND circuit 104 operates on the ERR/ERF primary input signal, the inverse of the ERR/ERF secondary input signal from the inverter 100, and an inverse from an inverter 108 of an internal gating signal from a delayed one-shot vibrator circuit 110. The delayed one-shot vibrator circuit 110 corresponds to the adjustable delay and one-shot vibrator blocks 64 and 66 of FIG. 4

TABLE 1

| Signal Name | Type of Edge | When | Results |
|---|---|---|---|
| ERR Pri. | Rising | SEC Low and SUS output Low | ERR set/ |
| | | SEC High or SUS output High | Internal gating start |
| | | | Ignore |
| | Falling | Any case | ERR reset |
| ERR Sec. | Rising | Any case | SUS reset |
| | Falling | Pri High | SUS set |
| | | Pri Low | Ignore |
| Internal Gating | Rising | Pri High and SEC Low | SUS set |
| | | Pri Low or SEC High | Ignore |
| | Falling | N/A | N/A |

Figure 6A:
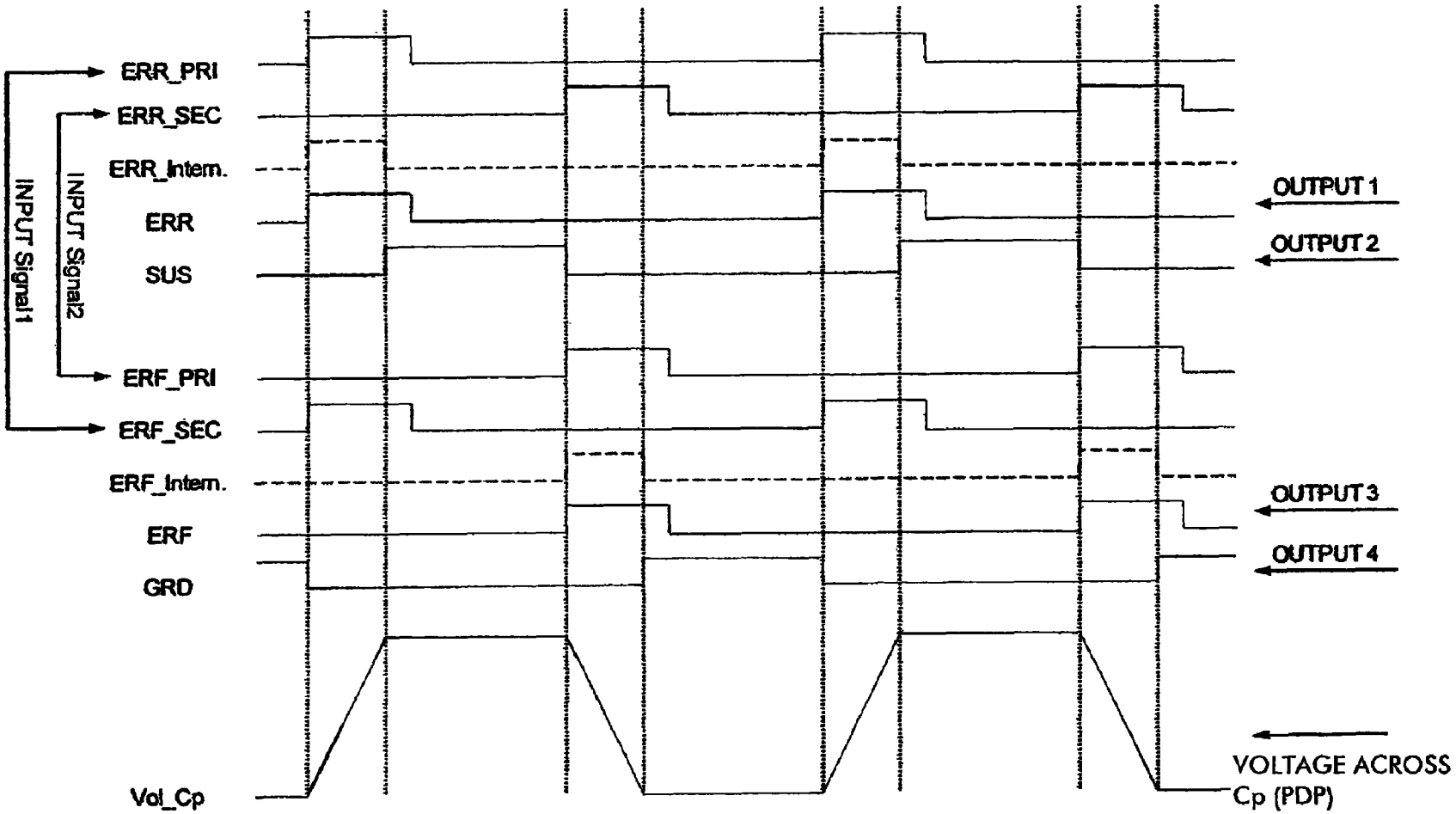
FIGS. 6*a*-6*d* are graphs corresponding to possible operating modes of the PDP sustain driver of the present invention allowed by the logic functional block of FIG. 5.
Figure 6B:
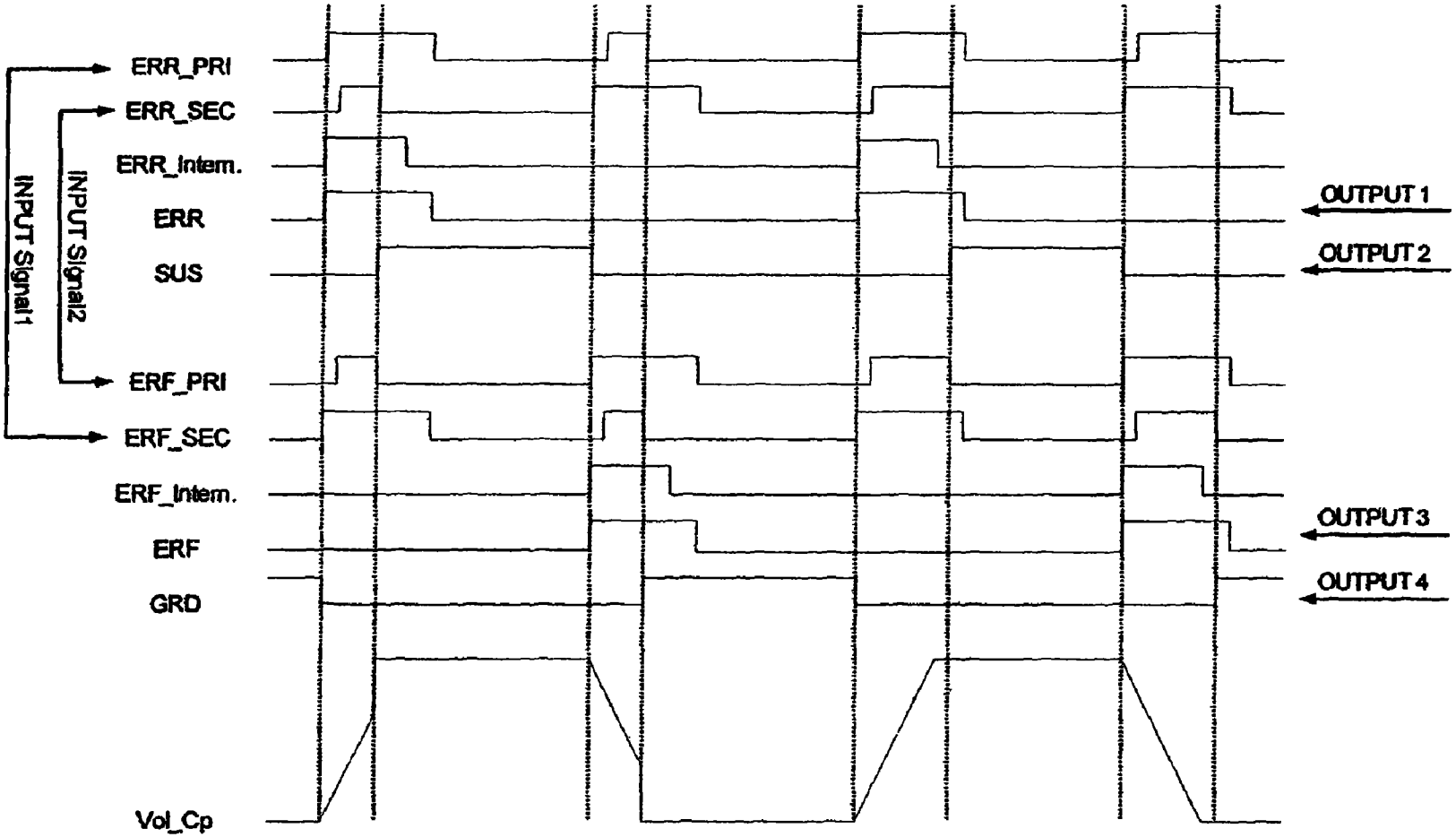
Figure 6C:
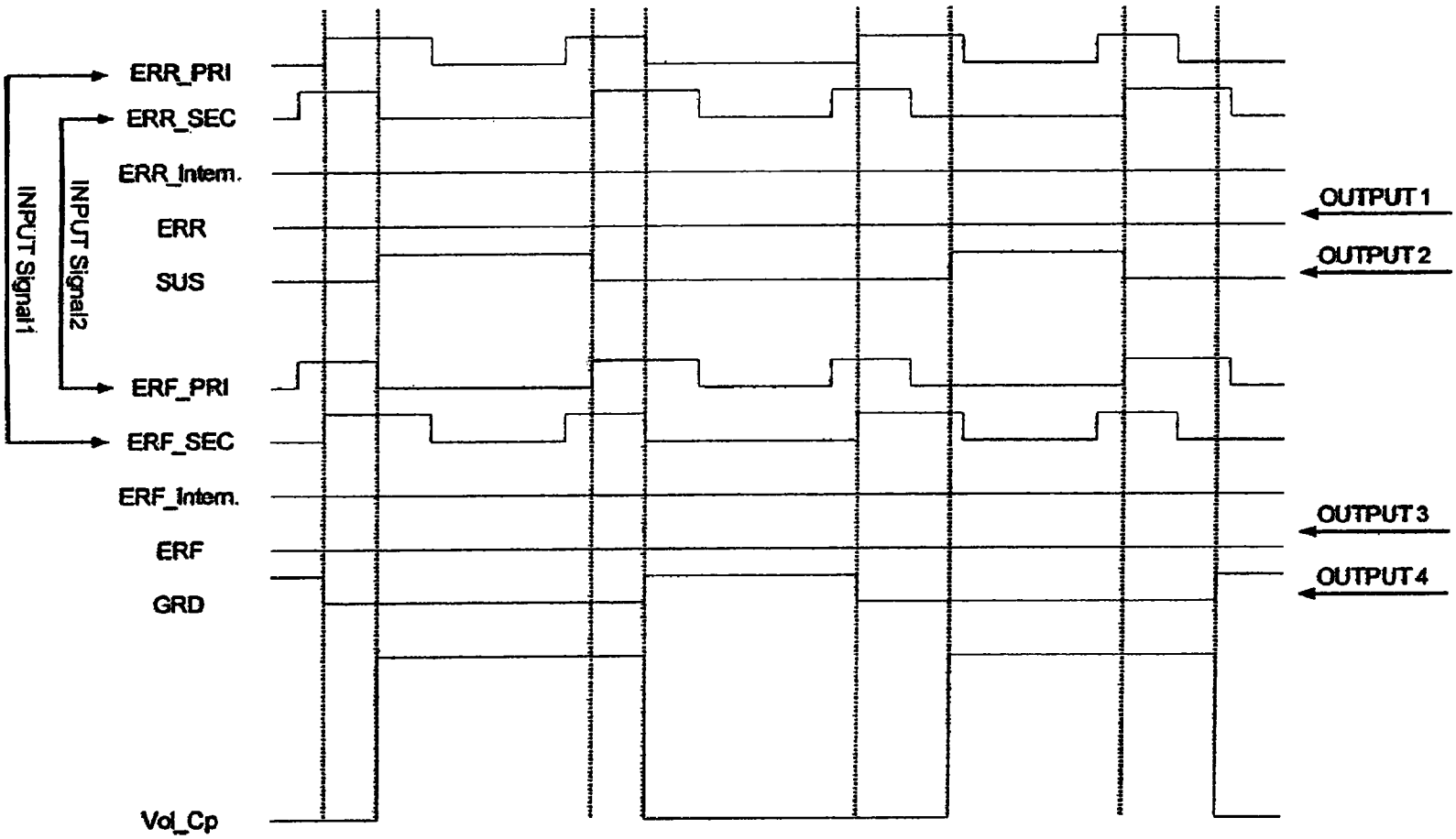
Figure 6D:
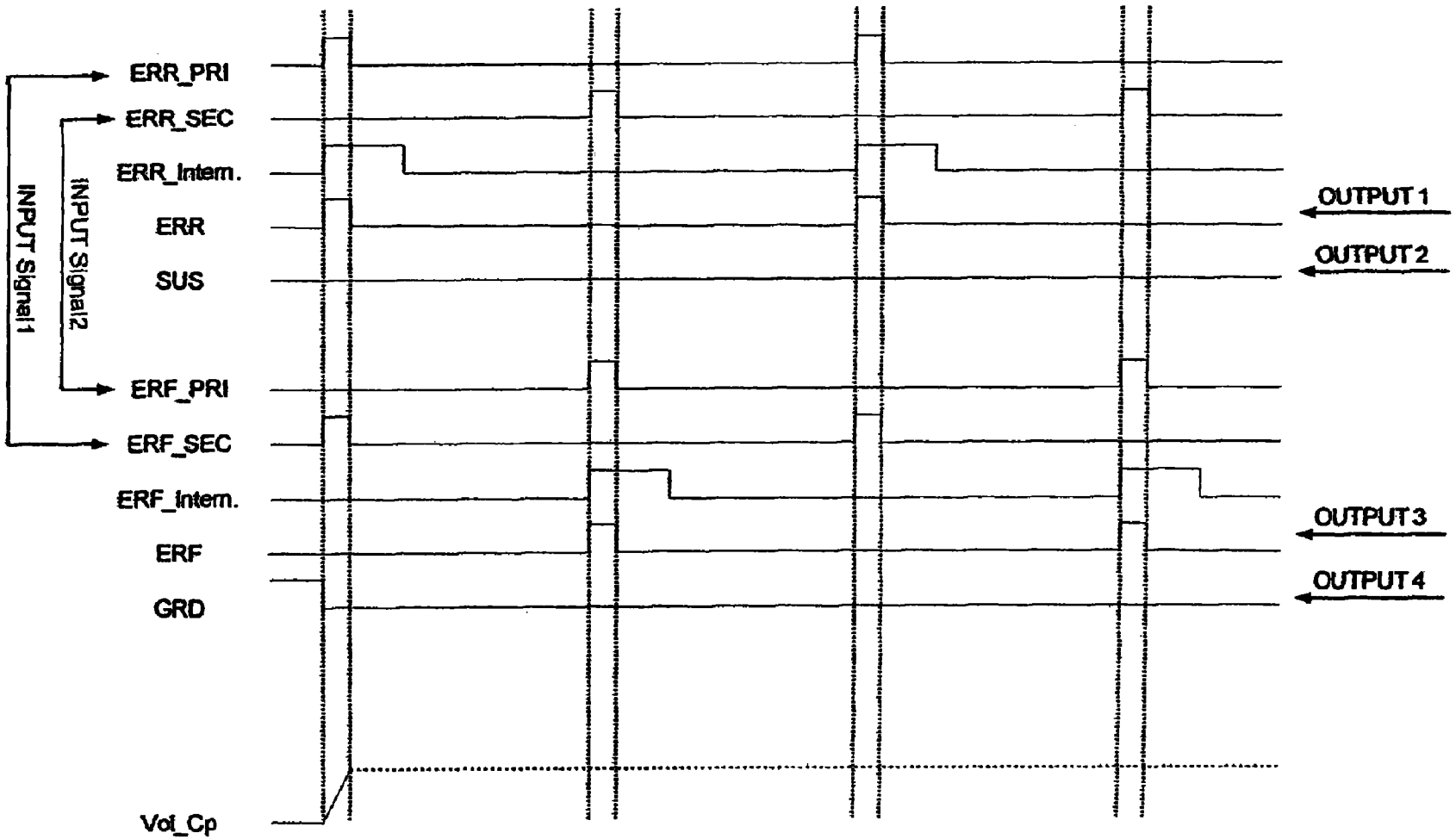

The above discussed invention reduces input signals for sustain driver by half and minimize auxiliary circuit, PCB pattern, and system circuit space and cost. Regardless of reduced input signals, the inventive HVIC can drive various operating modes. The possible operating modes that may be performed by the logic functional block 50 of FIG. 5 are shown in FIGS. 6*a*-6*d*. These modes are useful for a PDP system designer who may want to implement various operating modes regardless of reduction of the input signals to the inventive HVIC. FIG. 6*a* illustrates an efficient soft switching mode; FIG. 6*b* illustrates a partial hard switching mode; FIG. 6*c* illustrates a hard switching mode; FIG. 6*d* illustrates a floating mode.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A PDP sustain driver circuit including at least one high voltage gate driver IC (HVIC) comprising a logic functional block, the circuit comprising:

a signal buffer for receiving two input signals and directly providing the two input signals to the logic functional block; and at least four switches including a charging switch, a discharging switch, a sustain switch and a grounding recovery switch, the HVIC generating four unique control signals from the two input signals and providing the four unique control signals to the four switches to individually control each of said four switches;

at least one of the four unique control signals dependent on sensed information from two of the at least four switches.

2. The circuit of claim 1, wherein the PDP sustain driver is a bridge driver with soft switching for a capacitive load.

3. The circuit of claim 1, wherein the charging and discharging switches are coupled as a first half-bridge and the sustain and grounding recovery switches are connected as a second half-bridge.

4. The circuit of claim 1, wherein the HVIC senses voltage on at least one of the sustain and grounding recovery switches and a sensed result is provided to the logic functional block as a delay setting for the at least one of the sustain and grounding recovery switches.

5. The circuit of claim 4, wherein user set information is provided to the logic functional block as a delay setting of the at least one of the sustain and grounding recovery switches instead of the sensed result.

6. The circuit of claim 5, wherein two settings of the user set information are provided.

7. The circuit of claim 4, wherein the sensed result is used to optimize gating of the sustain driver.

8. The circuit of claim 1, wherein the HVIC further comprises a gate driver for processing output signals of the logic functional block and providing at least two of the four unique control signals for controlling the switches.

9. The circuit of claim 8, wherein the at least two of the four unique control signals enable at least two operating modes.

10. The circuit of claim 1, wherein the logic functional block is integrated with HVIC.

11. The circuit of claim 1, comprising a plurality of HVICs.

12. The circuit of claim 11, wherein the HVICs share the two input signals.

13. The circuit of claim 1, wherein the logic functional block further comprises first and second flip-flops, the first flip-flop providing charge ERR and discharge ERF control signals and the second flip-flop providing sustain SUS and grounding recovery GRND control signals.

14. The circuit of claim 13, wherein the first flip-flop receives a reset signal from a first inverter that inverts an ERR/ERF primary input signal; and a set signal from a first AND circuit that ands the ERR/ERF primary input signal, an inverse of an ERR/ERF secondary input signal from a second inverter, and an inverse output of the second flip-flop.

15. The circuit of claim 14, wherein the second flip-flop receives a reset signal from the ERR/ERF secondary input signal; and a set signal from a first OR circuit that operates on signals received from second and third AND circuits, the third AND circuit operating on the ERR/ERF primary input signal and the inverse of the ERR/ERF secondary input signal from the second inverter, the second AND circuit operating on the ERR/ERF primary input signal, the inverse of the ERR/ERF secondary input signal from the second inverter, and an inverse of an internal gating signal from a delayed on-shot vibrator circuit from a third inverter.

16. A logic functional block for use in a high voltage gate driver integrated circuit (HVIC), the logic functional block comprising:

a falling switch input corresponding to a sensed falling input signal, and a rising switch input corresponding to a sensed rising input signal;

wherein the logic functional block is configured to generate four unique control signals from the sensed falling switch input signal and the sensed rising switch input signal and provide the four unique control signals to a charging switch, a discharging switch, a sustain switch and a grounding recovery switch;

wherein the HVIC is adapted to control a plasma display panel (PDP);

at least one of the four unique control signals dependent on sensed information from two of the at least four switches.

17. The logic functional block of claim 16, wherein the logic functional block is configured to optimize gating of the sustain switch.

18. The logic functional block of claim 16, wherein the logic functional block is configured to receive a delay setting for one of the sustain switch and the grounding recovery switch.

19. The logic functional block of claim 18, wherein the delay setting corresponds to user set information.

20. The logic functional block of claim 16, further comprising a plurality of flip-flops, the first of the plurality of flip-flop providing the at least one of the four unique control signals to the charging switch and the second of the plurality of flip-flips providing the at least one of the four unique control signals to the discharging switch.

* * * * *